US007388735B2

(12) United States Patent
Chen

(10) Patent No.: US 7,388,735 B2
(45) Date of Patent: Jun. 17, 2008

(54) CURRENT INDUCTIVE TIMER SOCKET

(75) Inventor: Wan-Chiar Chen, Kaohsiung (TW)

(73) Assignee: Dinjoker Co., Ltd., Kaosiung (TW)

( * ) Notice: Subject to any disclaimer, the term of this patent is extended or adjusted under 35 U.S.C. 154(b) by 39 days.

(21) Appl. No.: 11/317,445

(22) Filed: Dec. 24, 2005

(65) Prior Publication Data

US 2007/0146957 A1 Jun. 28, 2007

(51) Int. Cl.
*H01H 47/02* (2006.01)
*H01H 47/32* (2006.01)
*H01H 51/30* (2006.01)

(52) U.S. Cl. ..... 361/160; 361/166; 361/169.1

(58) Field of Classification Search ..... 361/160, 361/166, 169.1
See application file for complete search history.

(56) References Cited

U.S. PATENT DOCUMENTS 3,786,312 A * 1/1974 Roussard ..... 361/643
3,913,153 A * 10/1975 Adams et al. ..... 5/616
3,920,961 A * 11/1975 Berg ..... 377/20
4,035,661 A * 7/1977 Carlson ..... 307/141
4,461,987 A * 7/1984 Fulton et al. ..... 318/800
4,588,901 A * 5/1986 Maclay et al. ..... 307/141

FOREIGN PATENT DOCUMENTS

JP 2001-287592 * 10/2001

OTHER PUBLICATIONS

Horowitz et al., The Art of Electronics, 1989, Cambridge University Press, 2nd edition, pp.565-569.*

* cited by examiner

*Primary Examiner*—Michael J Sherry
*Assistant Examiner*—Zeev Kitov
(74) *Attorney, Agent, or Firm*—Banger Shia

(57) ABSTRACT

A current inductive timer socket comprises: a principle relay circuit including an output relay and a voltage input terminal, a reed relay circuit including a capacitor, a plurality of diodes, a reed relay and a resistance, a counter circuit including a DC rectifier, seven series-connected counters, and a time select switch, a holding circuit including a neon light, a photodiode, an operational amplifier, a transistor, a diode and a resistance, a time switch circuit including three time switches, and three series-connected exciting transistors, and an inductive and amplification circuit including a transformer parallel-connected to a rated resistor, a set of two-stage operational amplifiers, a resistance, and a capacitor. When the electric appliance is in use, a signal of voltage drop produced at both ends of the rated resistor will be amplified by the operational amplifier and then transmitted to the counter circuit, making the counter circuit start to count automatically, and thus time operation is carried out.

2 Claims, 4 Drawing Sheets

CURRENT INDUCTIVE TIMER SOCKET

FIELD OF THE INVENTION

The present invention relates to a timer socket, and more particularly to a current inductive timer socket, when an electric appliance starts to operate, current will flow through the timer of the current inductive timer socket, turning on the timer and making it start to count, and after the timer counts to a predetermined value, it will cut off the power supply to the electric appliance.

DESCRIPTION OF THE PRIOR ART

Some people always forget to turn off the electric appliances after use, for example, forgetting to turn off the electric iron after ironing, this is not only power consuming but also the hot iron is likely to ignite the furniture, causing fire. Although the electric appliances may have a timer, if the user forgets to set it, the electric appliances will not be turned off automatically.

The present invention has arisen to mitigate and/or obviate the afore-described disadvantages.

SUMMARY OF THE INVENTION

To solve the abovementioned problems, the present invention provides a timer socket that can carry out a timing operation automatically by sensing the working status of the electric appliance, that is, as long as the electric appliance connected to the timer socket is switched on, the timer inside the timer socket will starts counting automatically, and after counting to a predetermined value, it will cut off the power supply to the electric appliance, ensuring that the electric appliance can be used safely. This timer socket can provide a timing function for those electric appliances without timing function, and can remedy the shortcomings of the electric appliances with timing function. Because people usually forget to set the timer of the appliances during use, so that the electric appliances may keep turning on after use, wasting power or even causing fire.

The current inductive timer socket provided in accordance with the present invention comprises: a principle relay circuit, a reed relay circuit, a counter circuit, a holding circuit, a time switch circuit, an inductive and amplification circuit, a household electric appliance socket, and a second timer socket. The principle relay circuit includes two voltage input terminals A, B, and an inductive output relay having three contact points: C, NC and NO. The voltage input terminal, under the control of the output relay, outputs power to the household electric appliance socket or to the second current inductive timer socket. The reed relay circuit includes a capacitor, a plurality of diodes, a reed relay and a resistance, and is used to receive signals from exciting transistors of a time switch circuit, and to start the output relay. The counter circuit includes a DC rectifier, seven series-connected counters, and a time select switch. The holding circuit, when the set time is up, the output relay will be started, and the common contact of the output relay will be disconnected from the normal close contact. Therefore, a voltage will be produced between the common contact and the normal close contact, and the voltage will then turn on the neon light, illuminating the photodiode, so that the reed relay will be kept turning on. The time switch circuit includes three time switches, and three series-connected exciting transistors, and the time units of the three time switches are minute, ten minute and hour. The inductive and amplification circuit includes a transformer parallel-connected to a rated resistor and a set of two-stage operational amplifiers. With the abovementioned circuits, during use of an electric appliance, a signal of voltage drop will be produced at both ends of the rated resistor, and then will be amplified by the operational amplifier and transmitted to the counter circuit, making the counter circuit start to count automatically, and thus time operation is carried out.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
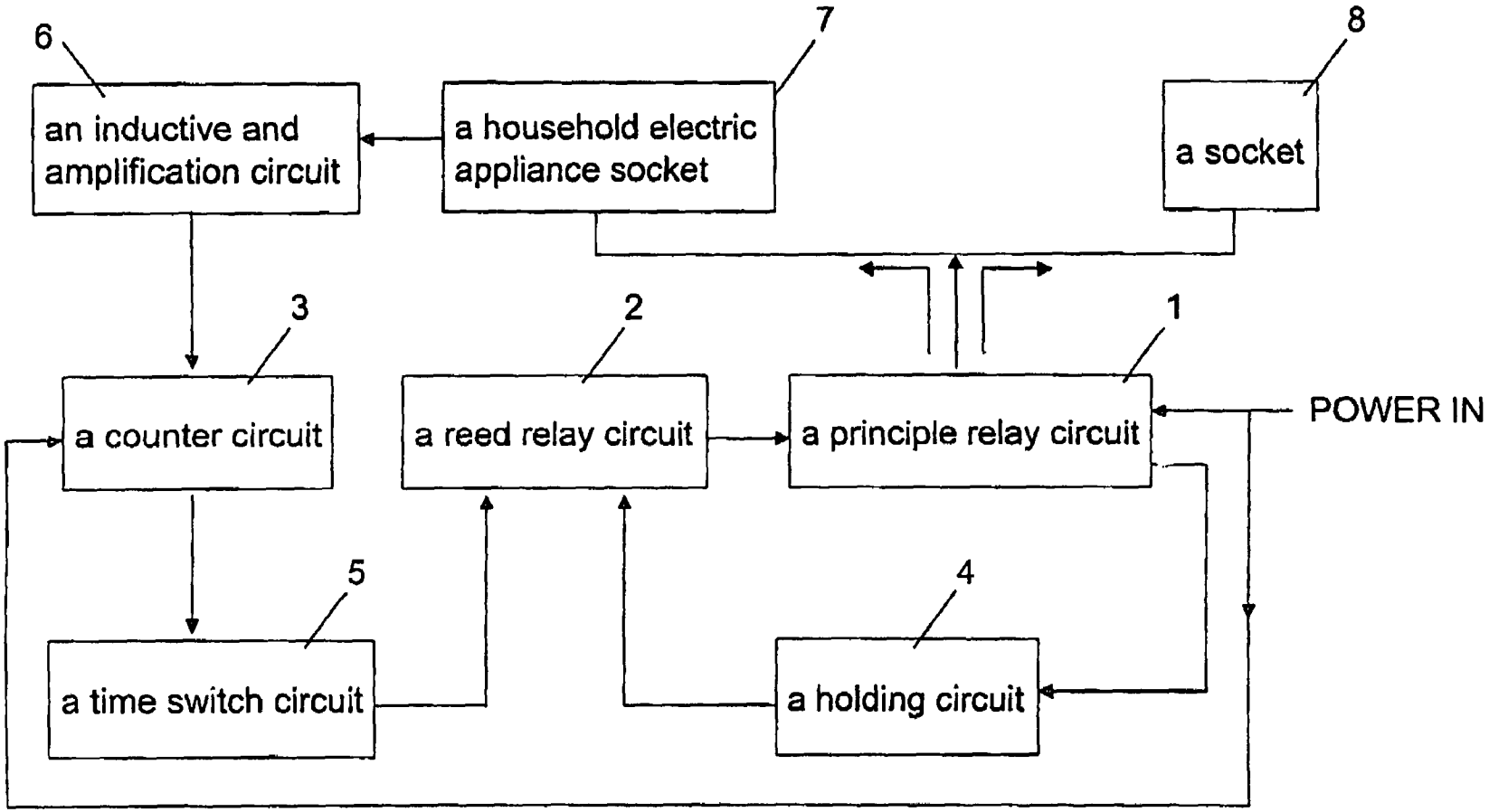
FIG. 1 is a block diagram of showing a control circuit of a current inductive timer socket in accordance with the present invention.

Referring to FIGS. 1-4, a current inductive timer socket in accordance with the present invention is illustrated and comprises a principle relay circuit 1, a reed relay circuit 2, a counter circuit 3, a holding circuit 4, a time switch circuit 5, an inductive and amplification circuit 6, a household electric appliance socket 7, and a socket 8 for connection of another current inductive timer socket. The principle relay circuit 1 includes two voltage input terminals A, B, and an inductive output relay having three contact points: C, NC and NO. The output relay is used to control the power transmitted to the household electric appliance socket 7 and the socket 8. Therefore, the present invention allows a plurality of current inductive timer sockets to be connected in series, and each of the current inductive timer sockets is then connected in series to electric equipments. The current inductive timer sockets are set differently so that the electric equipments can be controlled to work according to the predetermined program.

The reed relay circuit 2 includes a rectifying and filtering capacitor 2C, two diodes D1, D2, a reed relay 21, and a resistance 2R. The reed relay circuit 2 is used to receive the signal from the exciting transistors Tr1, Tr2 and Tr3 of the time switch circuit 5, and to drive the output relay 11. The counter circuit 3 includes a DC rectifier, an inverter 3C9, and seven series-connected counters 3C1-3C7 that are senary, decimal, senary, decimal, decimal, senary and decimal. The counter 3C1 has an input terminal P, and the counter 3C3 has an input terminal Q. When a time select switch 3S1 is started, current will flow from the inverter 3C9 to the point P, the longest set time is 9 hours and 59 minutes. When the current flows from inverter 3C9 to the point Q, the longest set time is no more than 9 minutes and 59 seconds. The holding circuit 4 plays an important role when the electric appliance is in use, when the set time is up, the output relay 11 will be started, and the common contact C of the output relay 11 will be disconnected from the normal close contact NC. The common contact C is connected to the power source point A, the normal close contact NC will be connected to the household appliance socket 7 via a rated resistor RM, and finally will be connected to the power source point B after passing through the inner circuit of the electric appliance (when the electric appliance is in use, its inner circuit is turned on). Therefore, a reverse voltage will be produced between the common contact C and the normal close contact NC. The voltage will then turn on the neon light 41 to illuminate the photodiode 42, so that the reed relay 21 is maintained in an "on" state, the output relay 11 also will be kept in an "on" state, and thus the set time is up, turning off the electric appliance. Therefore, the holding circuit 4 includes the neon light 41, the photodiode 42, an operational amplifier OP3, a transistor Tr4, a diode D4 and a resistance 4R.

The time switch circuit 5 includes three time switches 5S1, 5S2 and 5S3, and three series-connected exciting Transistors Tr1, Tr2 and Tr3, and the time units of the time switches 5S1, 5S2 and 5S3 are minute, ten minute and hour. Between the counters 3C5, 3C6, 3C7 and the minute time switch 5S1, the ten-minute time switch 5S2, the hour time switch 5S3 are connected a minute diode 5D1, a ten-minute diode 5D2 and a hour diode 5D3, so as to stabilize the signal. The time switches 5S1, 5S2 and 5S3 can be dip switch or rotary switch. The rotary switch is a "one-input ten-output and one-input six-output" element. The time select switch 3S1 has a minute's time set and an hour's time set. The inductive and amplification circuit 6 includes a transformer T parallel-connected to the rated resistor RM, a set of two-stage operational amplifiers OP1, OP2 parallel-connected to a resistance 6R, and a capacitor. The inductive and amplification circuit 6 serves to provide voltage-stabilized current for the counter circuit 3.

Figure 2:
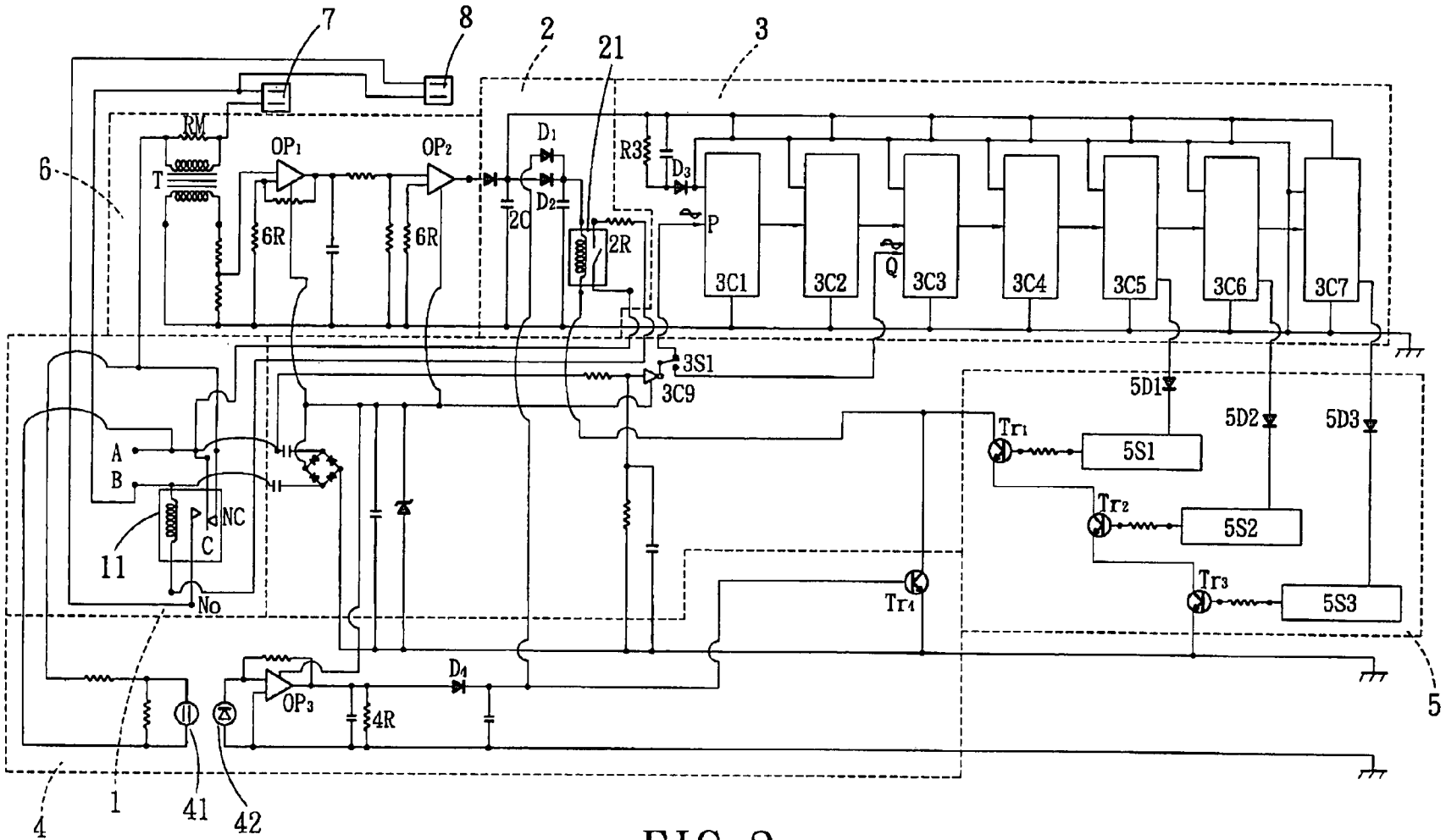
FIG. 2 is a circuit diagram of showing the control circuit a current inductive timer socket in accordance with the present invention.
Figure 3:
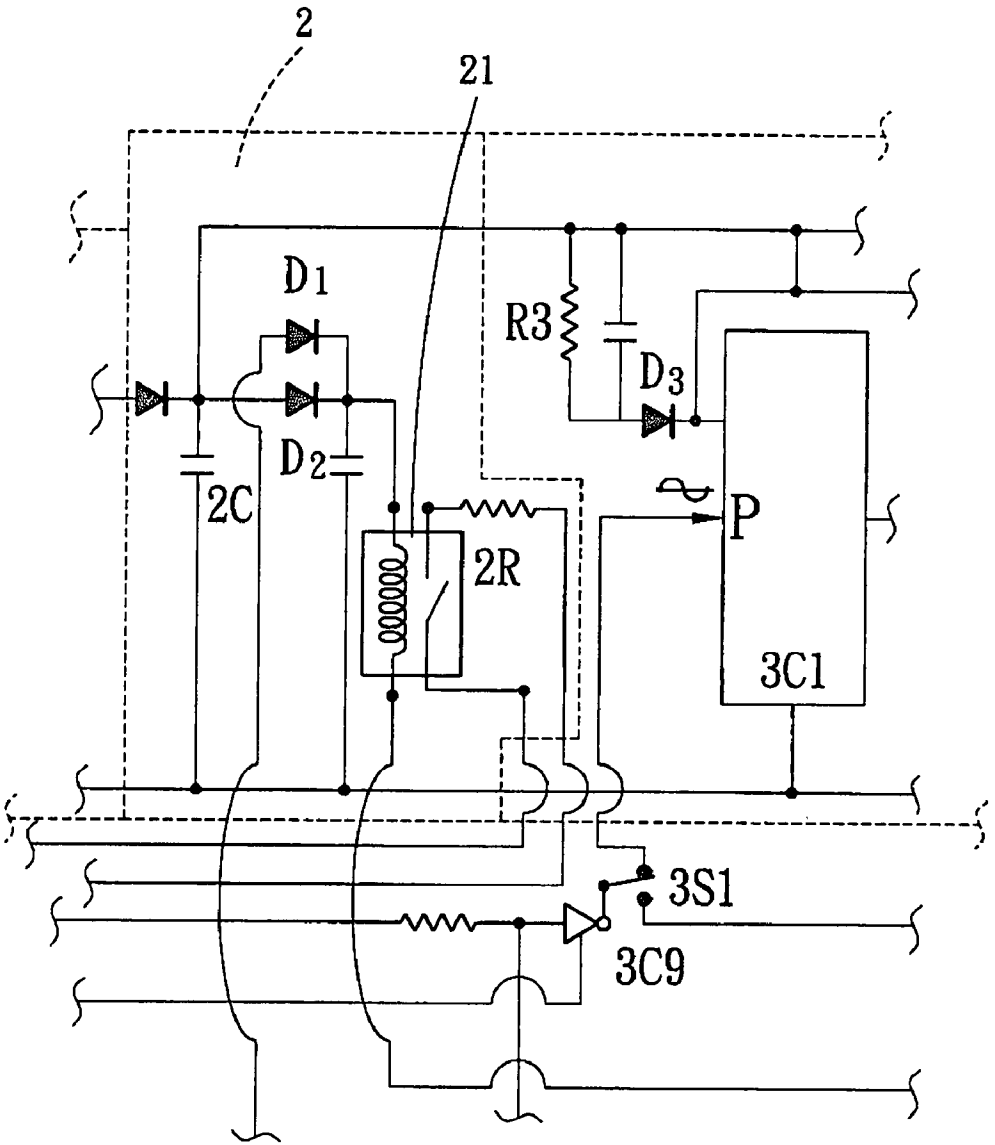
FIG. 3 is an enlarged view of a part of the control circuit a current inductive timer socket in accordance with the present invention.
Figure 4:
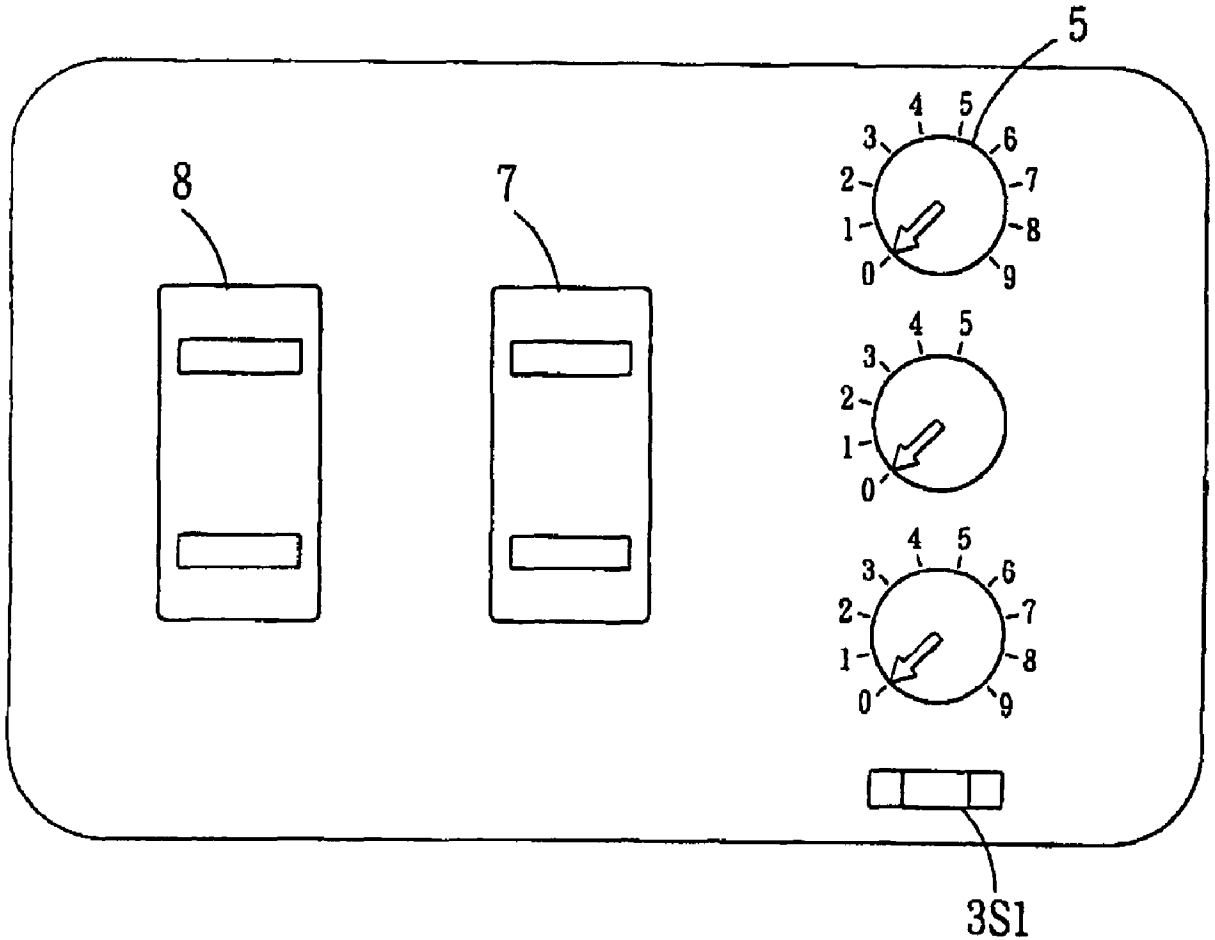
FIG. 4 shows the current inductive timer socket in accordance with the present invention.

As shown in FIG. 2, after the time switches 5S1, 5S2 and 5S3 are set, and the plug of the household electric appliance is inserted in the household electric appliance socket 7, the household electric appliance can start to work. During use, current will pass through the electric appliances, for example, a 110 v, 100 w electric appliance will have 0.9 A current, and the current will also pass through the rated resistor RM, producing a voltage drop at both ends of the rated resistor RM. The minor voltage drop will be considered as a signal and then will be amplified and transmitted to the counter circuit 3, so as to start the counters 3C1-3C7. At this moment, the timer function begins to take effect. The specification of the rated resistor RM is related to the specification of the electric appliance. If the rated resistor RM is too great, it will produce a lot of heat, and if the rated resistor RM is too small, the counters cannot be started. If the rated resistor RM is 0.01 ohm, the power of the corresponding electric appliance should range from 30-1000 w.

As shown in FIG. 2, the minor voltage drop is considered as a signal that is to be amplified by the operational amplifiers OP1 and OP2, and then it will pass through a diode D3, a resistance R3 and will be transmitted to the counters 3C1-3C7, at the same time, the counters are returned to zero. After that, the counters 3C1-3C7 start to count based on the household current of 60 cycles per second. When the original preset time set by time switches 5S1, 5S2 and 5S3 expires, the exciting transistors Tr1, Tr2 and Tr3 of the time switch circuit 5 will enable the reed relay 21 and the output relay 11 to cut off the electric supply, thus turning off the electric appliance automatically.

During use of the electric appliance, when the set time is up, the common contact C of the output relay 11 will be disconnected from the normal close contact NC. The common contact C is connected to the power source point A, the normal close contact NC will be connected to the household appliance socket 7 via a rated resistor RM, and finally will be connected to the power source point B after passing through the inner circuit of the electric appliance (when the electric appliance is in use, its inner circuit is turned on). Therefore, a voltage will be produced between the common contact C and the normal close contact NC. The voltage will then turn on the neon light 41, illuminating the photodiode 42, namely, photocoupler. The photocoupler will produce a signal voltage that will be amplified by the operational amplifier OP3 and transmitted to the transistor Tr4, enabling the reed relay 21 to keep the output relay 11 on, thus the timing operation is finished. After that, if the user turns off the switch of the electric appliance, the circuit, consisted of the normal close contact NC of the output relay 11, the rated resistor RM, the household electric appliance socket 7, the inner circuit of the electric appliance and the power source point B, will be cut off. As a result, the voltage between the common-contact C and the normal close contact NC will disappear, and the neon light 41, the photodiode 42 and the operational amplifier OP3 will be turned off. Meanwhile, the reed relay 21 will be opened, and the output relay 11 will be restored to normal. In this way, another cycle of timing operation can start when the electric appliance is used again.

The working principle of the holding circuit 4 is explained in FIG. 2:

Basically, the holding circuit 4 lets the neon light 41 and the photodiode 42 do the photocoupling. If the neon light 41 is turned on, the photodiode 42 will produce signals and then are series-connected to and amplified by the operational amplifier op3 and rectified into DC current to be supplied to the reed relay 21 and the transistor Tr4. therefore, the holding circuit 4 operates only when the neon light 41 is turned on.

When the neon light is turned on, its current flows like this: the power source point A→neon light 41→rated resistor RM→electric appliance socket 7 the electric appliance plugged in the electric appliance socket 7→electric appliance socket 7→power source point B. therefore, turning on the neon light 41 should satisfy two conditions: the first one is that the switch of the electric appliance plugged in the electric appliance socket 7 must be switched on to form a connected loop for the electric appliance, otherwise, the abovementioned loop is broken (disconnected) and of course, the cannot turned on. The other condition is that, when the output relay 11 is in operating state (namely its common contact C and the normal close contact NC are disconnected), since one end of the neon light 41 is connected to the common contact C of the output relay 11, and the other end is connected to the normal close contact NC via resistor, if, in normal state, the common contact C of the output relay 11 is connected to the normal close contact NC, the neon light has no power and certainly cannot be turned on. Therefore, only when the set time is up, and the output relay 11 starts to operate and its common contact C is disconnected from the normal close contact NC, then the neon light 41 can be turned on.

When the both conditions are satisfied, namely, firstly, the set time is up, and the output relay 11 starts to operate and its common contact C is disconnected from the normal close contact NC. Secondly, at this moment, the switch of the electric appliance plugged in the electric appliance socket 7 is still in the switched on state, the neon light 41 can be turned on, and then the photodiode 42 operates, and the operational amplifier OP3 instantly outputs power to the reed relay 21 and the transistor Tr4, enabling the reed relay 21 to be maintained in an operating state and making the output relay 11 keep supplying power to the socket 8, thus eliminating the oscillation phenomenon caused by the intermittent operation of the output relay 11, and also preventing the electric appliance from being burned.

The inductive and amplification circuit 6 is truly a power supply of the counter circuit, as shown in FIG. 2. When the electric appliance plugged in the electric appliance socket 7 starts to operate, current must flow through the rated resistor RM inside the inductive and amplification circuit 6 and forms a signal of voltage drop at both ends of the rated resistor RM, and the voltage drop signal is amplified by the transformer T and series-connected to and amplified by the operational amplifiers OP1 and OP2, and finally is divided into two parts: one is rectified by the diode D3 and supplied to the counters 3C1-3C7 as a power source and returns to zero. Another part is processed by the diode D2 and supplied to the reed relay 21 as a power source. Therefore, basically the inductive and amplification circuit 6 is a power supplier and a detecting device for detecting whether the electric appliance plugged in the electric appliance 7 is in use or not.

The present invention has the following advantages: during use of the electric appliance, the current passing through the electric appliance will activate the timer of the current inductive timer socket automatically. If the rotary button or key of the time is not adjusted, the set time will not be changed and needn't to be set every time, this is helpful to the forgetful user. If the electric appliance is broken or the user forgets to turn it off, the present invention can turn off the electric appliance automatically. For example, it is very dangerous if an electric cooker cannot be turned off due to the failure of its temperature-control switch. However, it will be safer and the electric cooker can be turned off automatically if it is connected to a current inductive timer socket. Furthermore, the present invention allows a plurality of current inductive timer sockets to be connected in series, and each of the current inductive timer sockets is then connected in series to electric equipments. The current inductive timer sockets are set differently so that the electric equipments can be controlled to work according to the predetermined program.

In addition, the combination of the holding circuit 4 and the reed relay circuit 2 is a linked device and can be replaced by the following devices: 1) using a photcoupler consisted of a light resistance Cds and a neon light to control a silicon control switch TRIAC, or 2) keep relay.

While we have shown and described various embodiments in accordance with the present invention, it should be clear to those skilled in the art that further embodiments may be made without departing from the scope of the present invention.

What is claimed is:

1. A current inductive timer socket comprising:

a principle relay circuit including an output relay and a voltage input terminal, the output relay controls a power transmitted from the voltage input terminal to a household electric appliance socket or a second current inductive timer socket; a reed relay circuit including a capacitor, a plurality of diodes, a reed relay and a resistance, and being used to receive signals from exciting transistors of a time switch circuit, and to start the output relay; a counter circuit including a DC rectifier, seven series-connected counters, and a time select switch; a holding circuit including a neon light, a photodiode, an operational amplifier, a transistor, a diode and a resistance;

a time switch circuit including three time switches, and three series-connected exciting transistors, and the time units of the three time switches are minute, ten minute and hour;

an inductive and amplification circuit including a transformer parallel-connected to a rated resistor, a set of two-stage operational amplifiers, a resistance, and a capacitor; a household electric appliance socket for connection of a household electric appliance; a second current inductive timer socket for connection of another current inductive timer socket;

the current inductive timer socket is characterized in that: the seven series-connected counters are senary, decimal, senary, decimal, decimal, senary and decimal, the holding circuit uses the neon light and the photodiode as a photocoupler whose signal is first amplified by the operational amplifier and then rectified into DC current by the diode, the DC current is partially supplied to the reed relay as power source and is partially used to drive the transistor and further to drive the reed relay, the time switch circuit includes three time switches for setting time by minute, ten-minute and hour, respectively, so as to set time accurately, such as 5 hours 38 minutes, the three series-connected transistors are capable of driving a 5-500 mA relay, the value of the rated resistor is 0.01-0.1 ohm, the rated resistor is able to sense the operation of an electric appliance with a power of 30 W-1000 W, an output of the operational amplifier is used as a power source for two circuits, part of the output of the operational amplifier passes through the diode to serve as a DC current power source of the counter circuit and return the counters to zero, and part of the output of the operational amplifier passes through the diode to serve as a power source of the reed relay, that is to say, only when the inductive and amplification circuit produces signals, the counter circuit is powered on return to zero and begins to count;

when an electric appliance is connected to the current inductive timer socket, a signal of voltage drop will be produced at both ends of the rated resistor, and then will be amplified by the operational amplifier and transmitted to the counter circuit, when the counter circuit counts to a predetermined value, the time switches will send signals to the three exciting transistors, so as to start the reed relay and the output relay, thus cutting off the power supply to the electric appliance, meanwhile, the holding circuit will keep the output relay on, thus a timing operation is finished, after that, if the user turns off a switch of the electric appliance, the holding circuit will make the output relay switch off, returning to its original state.

2. The current inductive timer socket as claimed in claim 1, wherein a combination of the holding circuit and the reed relay circuit is a linked device and is replaced by the following devices: 1) using a photcoupler consisted of a light resistance Cds and a neon light to control a silicon control switch TRIAC, or 2) keep relay.

* * * * *